US010394272B1

(12) United States Patent
Leckenby et al.

(10) Patent No.: US 10,394,272 B1
(45) Date of Patent: Aug. 27, 2019

(54) JOYSTICK CENTER LOCK

(71) Applicant: Sure Grip Controls, Inc., Saanichton (CA)

(72) Inventors: Stephen L. Leckenby, Victoria (CA); Brent L. Kornelson, Victoria (CA)

(73) Assignee: Sure Grip Controls, Inc., Saanichton (CA)

( * ) Notice: Subject to any disclaimer, the term of this patent is extended or adjusted under 35 U.S.C. 154(b) by 0 days.

(21) Appl. No.: 16/019,792

(22) Filed: Jun. 27, 2018

(51) Int. Cl.

| | |
|---|---|
| ***G05G 9/047*** | (2006.01) |
| ***G05G 5/06*** | (2006.01) |
| ***G05G 25/04*** | (2006.01) |
| ***G05G 1/04*** | (2006.01) |
| ***G05G 5/02*** | (2006.01) |
| ***G05G 5/00*** | (2006.01) |
| ***G05G 5/05*** | (2006.01) |
| ***G05G 5/28*** | (2006.01) |

(52) U.S. Cl.
CPC ..... *G05G 5/06* (2013.01); *G05G 1/04* (2013.01); *G05G 5/005* (2013.01); *G05G 5/02* (2013.01); *G05G 5/05* (2013.01); *G05G 5/28* (2013.01); *G05G 9/047* (2013.01); *G05G 25/04* (2013.01); *G05G 2009/04707* (2013.01); *G05G 2505/00* (2013.01)

(58) Field of Classification Search
CPC ..... G05G 9/047; G05G 2009/04707; G05G 2009/04733; G05G 5/005; G05G 5/28; G05G 5/02; G05G 5/05; G05G 5/06
See application file for complete search history.

(56) References Cited

U.S. PATENT DOCUMENTS

| | | | | |
|---|---|---|---|---|
| 5,953,196 | A | 9/1999 | Zimmermann | |
| 6,992,602 | B2 * | 1/2006 | Alexander | G05G 9/047 318/560 |
| 2005/0016822 | A1 | 1/2005 | Mowatt et al. | |
| 2007/0164996 | A1 | 7/2007 | Gould | |
| 2014/0251070 | A1 * | 9/2014 | Kornelson | G05G 5/06 74/523 |
| 2016/0306379 | A1 * | 10/2016 | Zils | G05G 5/02 |

FOREIGN PATENT DOCUMENTS

| | | |
|---|---|---|
| WO | 1997044723 | 11/1997 |

* cited by examiner

*Primary Examiner* — Luis A Gonzalez
(74) *Attorney, Agent, or Firm* — Luedeka Neely Group, P.C.; Rick Barnes

(57) ABSTRACT

A joystick including a main housing with a first control surface and a second control surface. A ball rotationally engages the first control surface. A shaft has a first end that releasably engages the ball. A shoe rotationally engages the second control surface. A main spring has a first end for pressing the shoe against the second control surface. A center lock housing engages a second end of the main spring and houses a slider and a lock spring. The slider selectively permits and prevents movement of the shoe along the shaft. The lock spring presses the slider into a desired default position. A knob releasably engages the second end of the shaft. A boot covers portions of the joystick.

3 Claims, 7 Drawing Sheets

JOYSTICK CENTER LOCK

FIELD

This invention relates to the field of joysticks. More particularly, this invention relates to locking a joystick in a centered position when it is not in use.

INTRODUCTION

Joysticks are commonly used for controlling the movement of an animated machine in two-dimensional or three-dimensional space. In many applications, very small movements of the joystick result in very large movements of the machine. Joysticks are often used to control large and powerful machines, and so it is very important that the movement of the joystick be carefully controlled, so that the movement of the machine is likewise carefully controlled.

To this end, joysticks have long had a self-centering mechanism of some type, so that if the operator releases the joystick, the joystick—and thus the machine—is returned to a home position—a position which is designed to be a safe position for the machine.

While this works well when the operator intentionally releases the joystick, it does nothing to prevent accidental bumping and resulting movement of the joystick, which can result in unintentional and catastrophic movement of the machine.

What is needed, therefore, is an apparatus that tends to reduce issues such as those described above, at least in part.

SUMMARY

The above and other needs are met by a joystick that has a main housing with a first control surface and a second control surface. A ball rotationally engages the first control surface. A shaft has a first end that releasably engages the ball. A shoe rotationally engages the second control surface. A main spring has a first end for pressing the shoe against the second control surface. A center lock housing engages a second end of the main spring and houses a slider and a lock spring. The slider selectively permits and prevents movement of the shoe along the shaft. The lock spring presses the slider into a desired default position. A knob releasably engages the second end of the shaft. A boot covers portions of the joystick.

According to another aspect of the invention there is described a joystick that has a main housing with a first control surface and a second control surface. A ball rotationally engages the first control surface. A shaft has a first end that releasably engages the ball. A shoe rotationally engages the second control surface. A main spring has a first end for pressing the shoe against the second control surface. A center lock housing engages a second end of the main spring and houses a slider and a lock spring. The slider has a tooth that selectively engages a slot in the center lock housing when the slider is in a detented position. The slider selectively permits and prevents movement of the shoe along the shaft. The lock spring presses the slider into a desired default position. A knob releasably engages the second end of the shaft. A boot covers portions of the joystick.

According to another aspect of the invention there is described a joystick that has a main housing with a first control surface and a second control surface. A ball rotationally engages the first control surface. A shaft has a first end that releasably engages the ball. A shoe rotationally engages the second control surface. A main spring has a first end for pressing the shoe against the second control surface. A center lock housing engages a second end of the main spring and houses a slider that extends completely through the center lock housing. The slider permits and prevents movement of the shoe along the shaft as the slider is selectively pressed to extend from one side of the center lock housing to another. A knob releasably engages the second end of the shaft. A boot covers portions of the joystick.

DRAWINGS

Further advantages of the invention are apparent by reference to the detailed description when considered in conjunction with the figures, which are not to scale so as to more clearly show the details, wherein like reference numbers indicate like elements throughout the several views, and wherein.

DESCRIPTION

Figure 1:
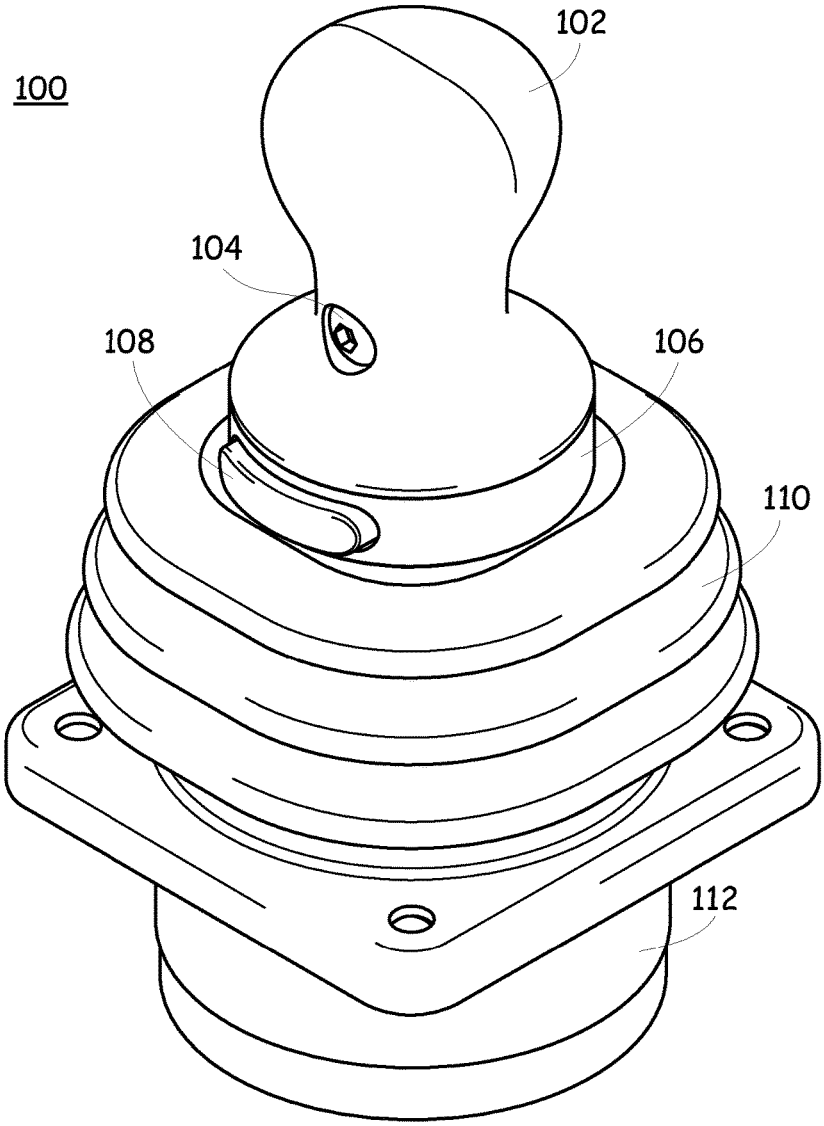
FIG. 1 is a perspective view of a joystick in a centered and locked position according to an embodiment of the present invention.

With reference now to FIG. 1, there is depicted a perspective view of a joystick 100 in a centered and locked position according to an embodiment of the present invention. The joystick 100 includes a knob 102, which is what the operator uses to control the joystick 100, by grasping the knob 102 with his hand, and moving the knob 102 in a direction that is associated with the desired direction of movement of the machine under the control of the joystick 102.

The joystick 100 includes a center lock housing 106 with a slider 108, the operation of which is described in more detail hereafter. A boot 100 covers certain parts of the joystick 100, as described in more detail below, and protects them from the environment in which the joystick 100 is used, which in some applications is one or more of humid, caustic, and dirty. Finally, a main housing 112 encloses internal parts of the joystick 100, and in some embodiment provides means for mounting the joystick 100.

Figure 2:
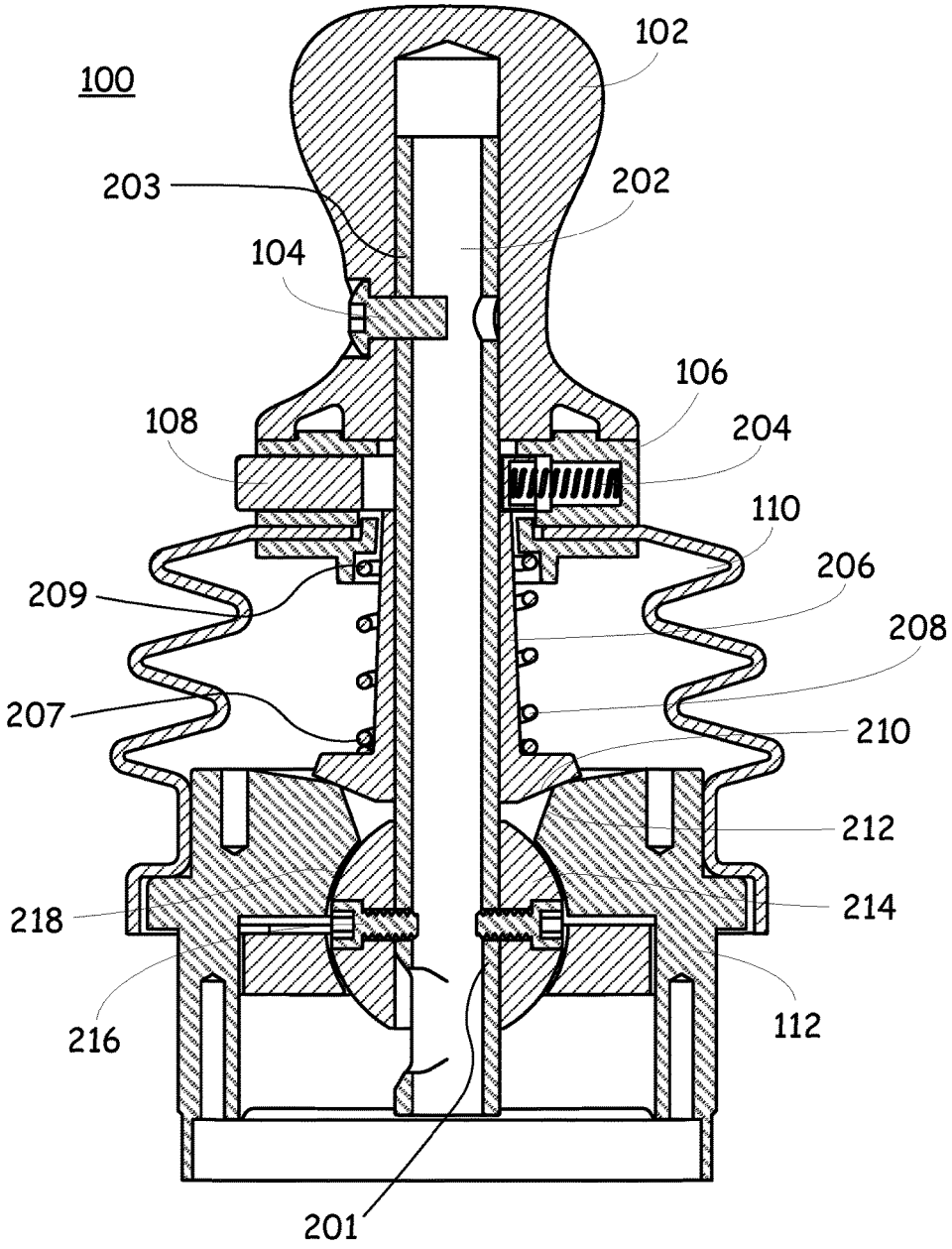
FIG. 2 is a cross-sectional view of a joystick according to an embodiment of the present invention.

With reference now to FIG. 2, there is depicted a cross-sectional view of the joystick 100 according to an embodiment of the present invention. As can be seen in FIG. 2, a shaft 202 runs from the knob 102 down into the main housing 112. The shaft 202 is retained to the knob 102 such as by a fastener 104 at a second end 203 of the shaft 202. At the opposing first end 201 of the shaft 202, the shaft 202 is retained to a ball 214, such as by one or more fasteners 216.

Portions of the exterior surface of the ball 214 engage a semi-spherical first surface 218 of the main housing 112. The first surface 218 has a hole formed in the center, which allows the shaft 202 to extend upwards through the first surface 218, but the hole is not sufficiently large that the ball 214 can pass through the hole. Thus, the ball 214 is retained beneath the first surface 218 within the main housing 112.

Above the first surface 218 is a semi-conical second surface 212. The second surface 212 engages a semi-conical shoe 210. A main spring 208 is disposed around the shoe 210, with a first end 207 of the main spring 208 pressing the shoe 210 against the second surface 212. The opposing second end 209 of the main spring 208 is pressed against the center lock housing 106, or against another element that is disposed adjacent the center lock housing 106. The center lock housing 106 is disposed adjacent the knob 102.

By retaining the shaft 202 in desired positions with both the knob 102 and the ball 214, the main spring 208 is held in compression, which tends to retain the ball 214 against the first surface 218 and the shoe 210 against the second surface 212. In this manner, the shoe 206 is allowed to move up and down along the shaft 202, and thus float across the second surface 212 as the knob 102 is used by the operator to pivot the shaft 202 around the ball 214. However, because of the semi-conical shapes of the shoe 210 and the second surface 212, the compression of the main spring 208 induces the shaft 202 to return to an upright and centered position in the housing 112 when an operator is not pressing it in an alternate position. This is the self-centering mechanism of the joystick 100.

Figure 3:
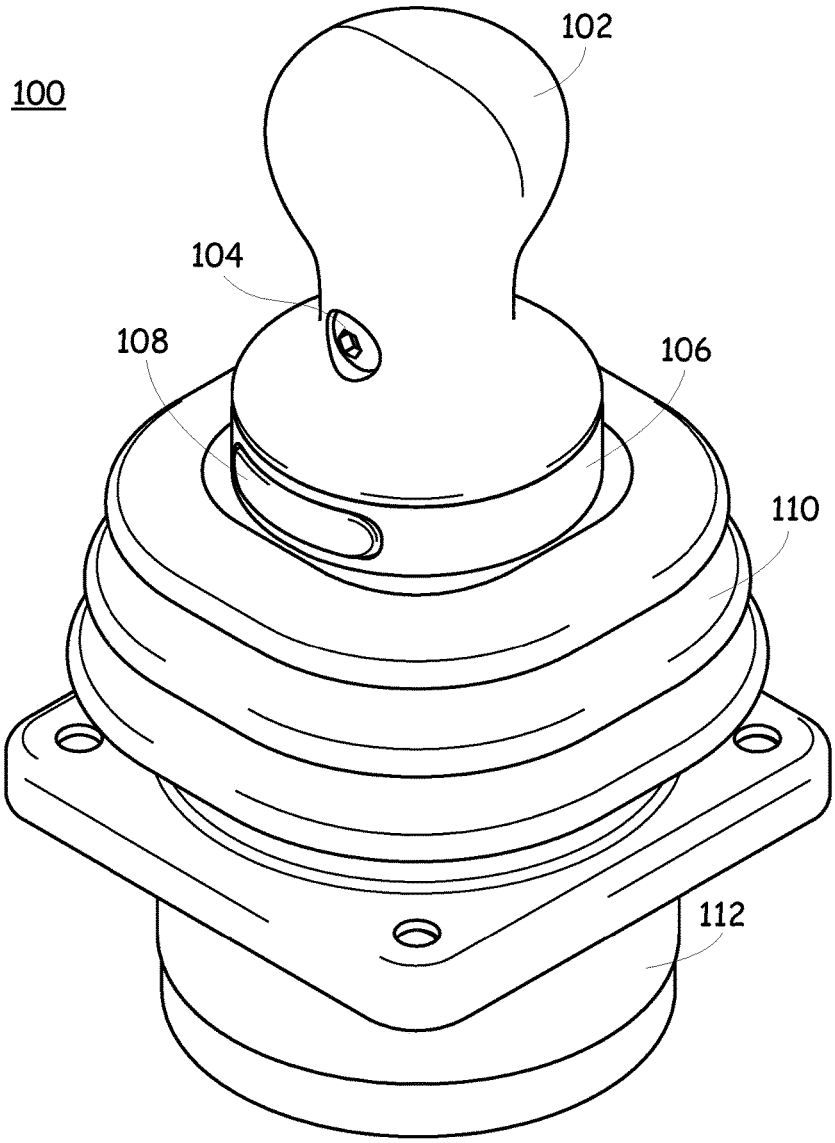
FIG. 3 is a perspective view of a joystick in a centered and unlocked position according to an embodiment of the present invention.

As seen in FIG. 2, the slider 108 in the center lock housing 106 can be in a first extended position, such that an outer surface of the slider 108 extends out past the surface of the center lock housing 106, or as depicted in FIG. 3, can be in a second depressed position, such that the outer surface of the slider 108 is substantially coplanar with the surface of the center lock housing 106.

Figure 4:
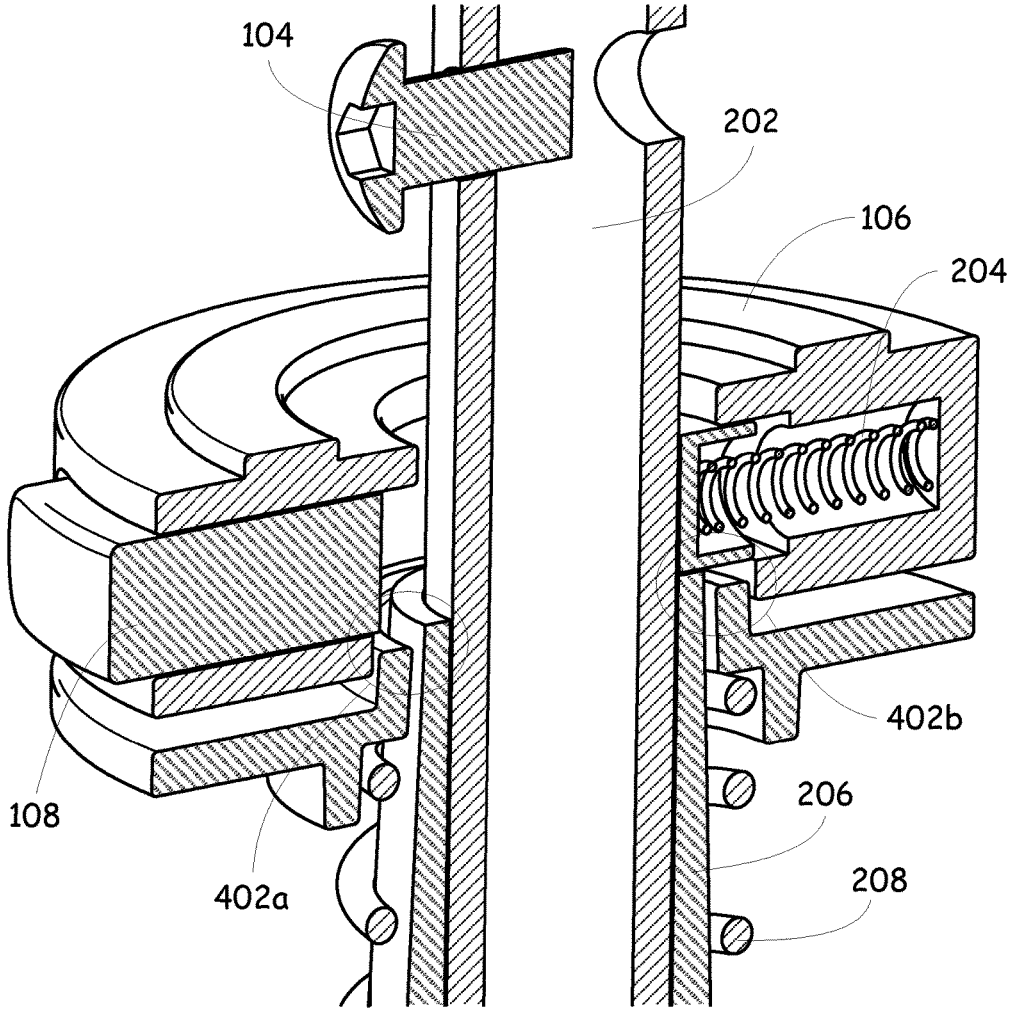
FIG. 4 is a perspective cross-sectional view of a portion of a joystick in a centered and locked position according to an embodiment of the present invention.

FIG. 4 is a perspective cross-sectional view of a portion of the joystick 100 in a centered and locked position according to an embodiment of the present invention. In this position, the operator is not moving the joystick 100 in any direction, and so the main spring 208 urges the shaft 202 into the centered position, as described above.

A center lock spring 204, disposed within the center lock housing 106, presses the slider 108 into the first extended position. As depicted in region 402*b*, when in this extended position, a portion of the slider 108 extends over the top of the shoe 206. With this portion of the slider 108 engaging the top of the shoe 206 in this manner, the shoe 206 is prevented from sliding across the second surface 212 of the main housing 112, because in order to do so, the shoe 206 would need to slide up along the shaft 202, and the slider 108 in this position is preventing such movement of the shoe 206 along the shaft 202.

Figure 5:
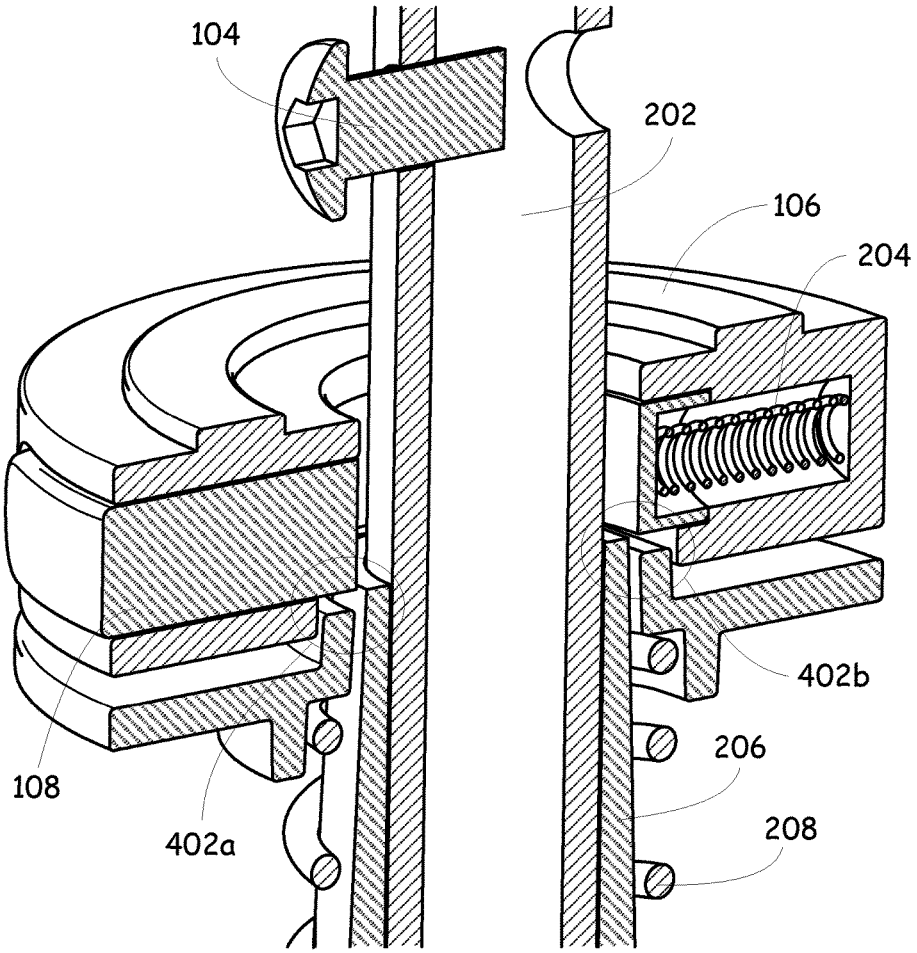
FIG. 5 is a perspective cross-sectional view of a portion of a joystick in a centered and unlocked position according to an embodiment of the present invention.

With reference now to FIG. 5, there is depicted a perspective cross-sectional view of a portion of the joystick 100 in a centered and unlocked position according to an embodiment of the present invention. In FIG. 5, the slider 108 has been pressed into the second depressed position, such as by an operator pressing the slider with his finger, and overcoming the pressure of the center lock spring 204.

Looking now at regions 402*a* and 402*b* of FIG. 5, it can be seen that no portion of the slider is disposed above the shoe 206, and thus no portion of the slider 108 prevents the shoe 206 from sliding up along the shaft 202, and the operator is free to move the position of the joystick 100 as desired. Thus, in the embodiment as depicted, with the slider 108 is in the extended first position as dictated by the center lock spring 204, the joystick 100 is locked in a center position. However, when an operator affirmatively presses the slider 108 into the depressed second position, overcoming the force of the center lock spring 204, the joystick 100 is no longer lock, and may be used to move the machine as desired.

In other embodiments the overlaps in regions 402*a* and 402*b* are reversed, such that the default position of the slider 108 is unlocked and pressing the slider 108 locks the joystick 100. In other embodiments the position of the slider 108 can be locked into the unlocked position by a first press of the slider 108, and then the slider 108 can be released from the unlocked position by pressing the slider 108 a second time.

Figure 6:
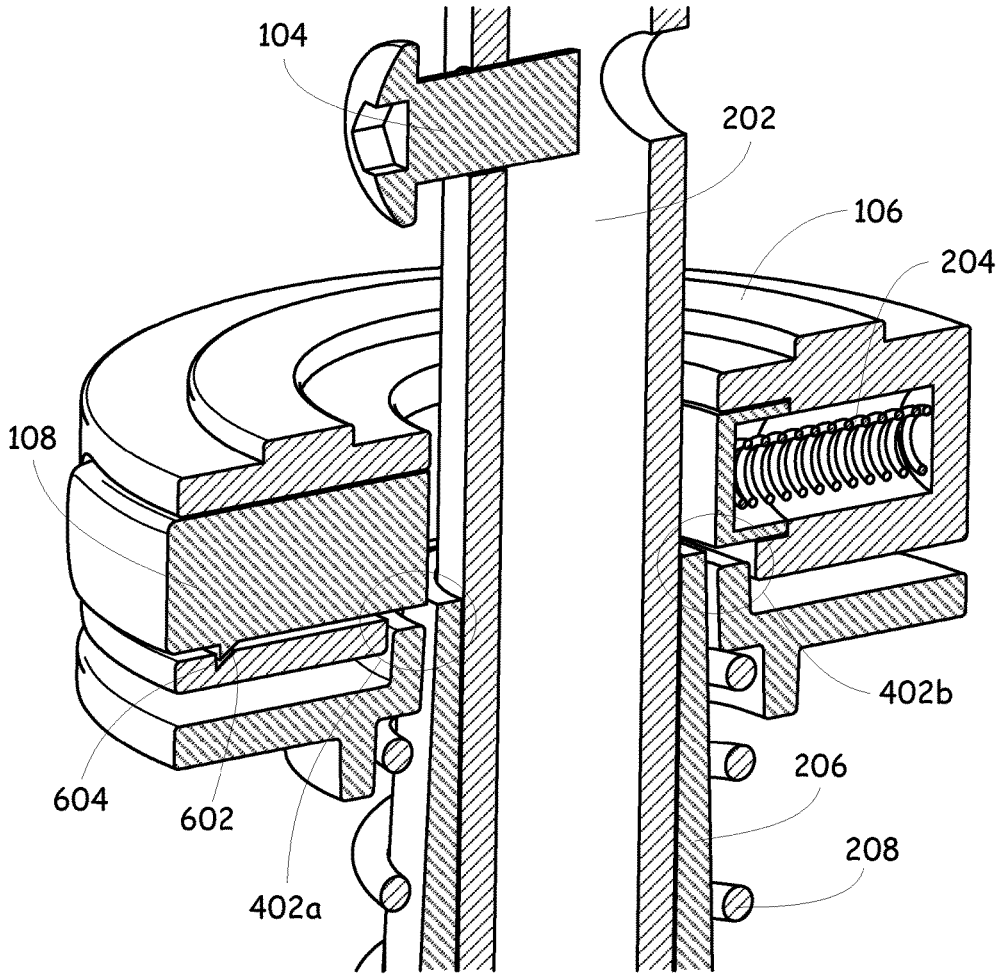
FIG. 6 is a perspective cross-sectional view of a portion of a joystick with a locking mechanism according to another embodiment of the present invention.

In one embodiment as depicted in FIG. 6, there is a slight gap between the bottom surface of the button 108 and the adjacent surface of housing 106. Disposed in the bottom surface of the slider 108 is a tooth 602 that aligns with a slot 604 in the adjacent surface of housing 106, when the slider 108 is pressed in by the operator. The operator is able to push the slider 108 down to engage the tooth 602 in the slot 604, thereby locking the slider 108 in the unlocked position, under the pressure exerted by the spring 204. Pressing the slider 108 again and pulling the button 108 slightly up disengages the tooth 602 from the slot 604, which allows the slider 108 to be returned to the locked position under the force of the spring 204. In this manner, the operator need not hold the slider 108 in the detented position for the entire time that the joystick 100 is unlocked and in use. It is appreciated that other means for locking the slider 108 in the detented and unlocked position are also comprehended herein.

Figure 7:
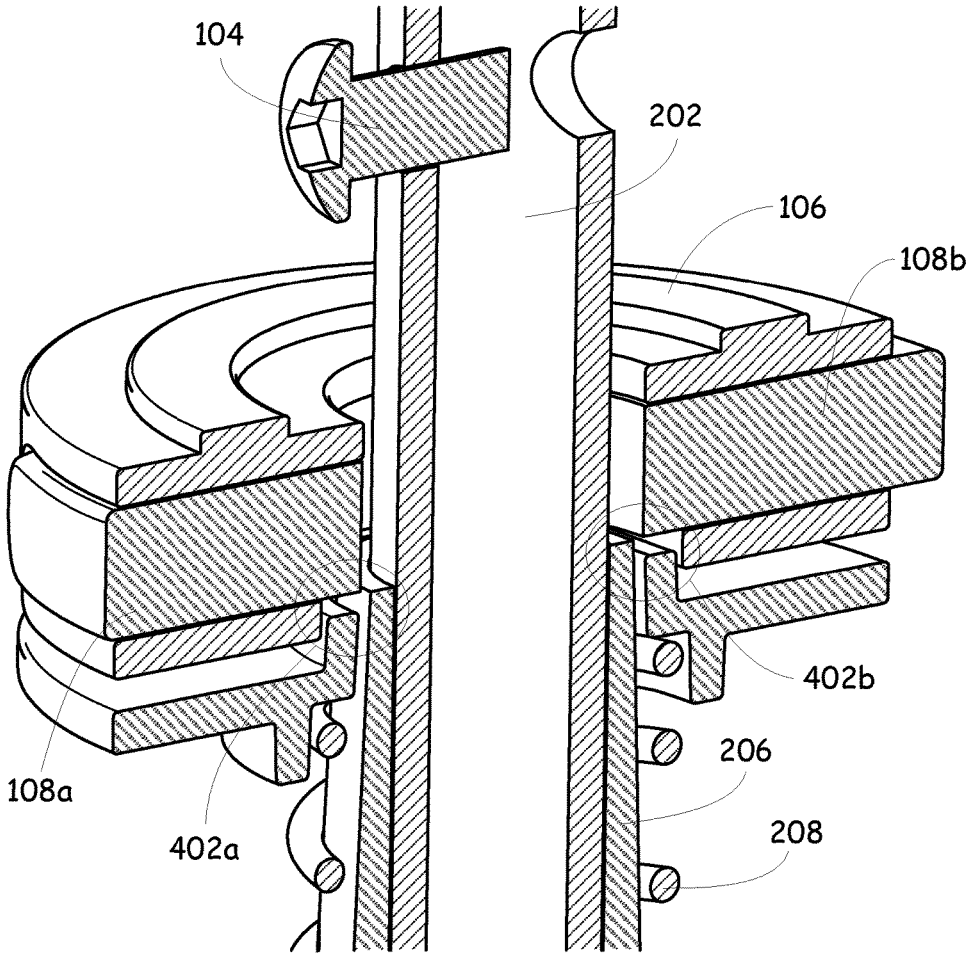
FIG. 7 is a perspective cross-sectional view of a portion of a joystick with a locking mechanism according to yet another embodiment of the present invention.

In one embodiment as depicted in FIG. 7, the slider 108 passes completely through the housing 106, and extends out the opposing side. The two ends 108*a* and 108*b* of the slider 108 are similar in appearance, but may have tactically-sensed indicia formed thereon such that the operator can distinguish the two ends 108*a* and 108*b* by feel. When the slider 108*a* is pressed, the locking mechanism 402*b* is released, and the joystick 100 is unlocked and able to be moved by the operator. When the slider 108*b* is pressed the locking mechanism 402*b* is engaged, and the joystick 100 is locked and unable to be moved by the operator. It is appreciated that other means for placing the slider 108 in locked and unlocked positions are also comprehended herein.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A joystick, comprising:

a main housing having a first control surface and a second control surface, a ball for rotationally engaging the first control surface, a shaft having a first end and a second end, the first end of the shaft for releasably engaging the ball, a shoe for rotationally engaging the second control surface, a main spring have a first end and a second end, the first end of the main spring for pressing the shoe against the second control surface, a center lock housing for engaging the second end of the main spring, and housing a slider and a lock spring, the slider for selectively permitting and preventing movement of the shoe along the shaft, the lock spring for pressing the slider into a desired default position, a knob for releasably engaging the second end of the shaft, and a boot for covering portions of the joystick.

2. A joystick, comprising:

a main housing having a first control surface and a second control surface, a ball for rotationally engaging the first control surface, a shaft having a first end and a second end, the first end of the shaft for releasably engaging the ball, a shoe for rotationally engaging the second control surface, a main spring have a first end and a second end, the first end of the main spring for pressing the shoe against the second control surface, a center lock housing for engaging the second end of the main spring, and housing a slider and a lock spring, the slider having a tooth that selectively engages a slot in the center lock housing when the slider is in a detented position, the slider for selectively permitting and preventing movement of the shoe along the shaft, the lock spring for pressing the slider into a desired default position, a knob for releasably engaging the second end of the shaft, and a boot for covering portions of the joystick.

3. A joystick, comprising:

a main housing having a first control surface and a second control surface, a ball for rotationally engaging the first control surface, a shaft having a first end and a second end, the first end of the shaft for releasably engaging the ball, a shoe for rotationally engaging the second control surface, a main spring have a first end and a second end, the first end of the main spring for pressing the shoe against the second control surface, a center lock housing for engaging the second end of the main spring, and housing a slider that extends completely through the center lock housing, the slider for permitting and preventing movement of the shoe along the shaft as the slider is selectively pressed to extend from one side of the center lock housing to another, a knob for releasably engaging the second end of the shaft, and a boot for covering portions of the joystick.

* * * * *